US007082702B2

(12) United States Patent
Cretinon

(10) Patent No.: US 7,082,702 B2
(45) Date of Patent: Aug. 1, 2006

(54) ARTICLE OF FOOTWEAR

(75) Inventor: Frederic Cretinon, Metz-Tessy (FR)

(73) Assignee: Salomon S.A., Metz-Tessy (FR)

( * ) Notice: Subject to any disclaimer, the term of this patent is extended or adjusted under 35 U.S.C. 154(b) by 26 days.

(21) Appl. No.: 10/720,109

(22) Filed: Nov. 25, 2003

(65) Prior Publication Data

US 2004/0111920 A1 Jun. 17, 2004

(30) Foreign Application Priority Data

Dec. 11, 2002 (FR) ..... 02.16239

(51) Int. Cl.
*A43B 13/12* (2006.01)

(52) U.S. Cl. ..... 36/88; 36/69; 36/30 R; 36/76 R; 36/107

(58) Field of Classification Search ..... 36/30 R, 36/76 R, 73, 88, 91, 75 R, 107, 108, 69
See application file for complete search history.

(56) References Cited

U.S. PATENT DOCUMENTS

| | | | | |
|---|---|---|---|---|
| 4,506,460 | A * | 3/1985 | Rudy | 36/28 |
| 4,638,576 | A * | 1/1987 | Parracho et al. | 36/68 |
| 4,766,679 | A * | 8/1988 | Bender | 36/30 R |
| 4,854,055 | A * | 8/1989 | Sugiyama et al. | 36/127 |
| 4,878,301 | A * | 11/1989 | Kiyosawa | 36/69 |
| 5,052,130 | A * | 10/1991 | Barry et al. | 36/107 |
| 5,408,761 | A * | 4/1995 | Gazzano | 36/88 |
| 5,465,509 | A | 11/1995 | Fuerst et al. | 36/88 |
| 5,720,118 | A * | 2/1998 | Mayer et al. | 36/107 |
| 5,915,820 | A * | 6/1999 | Kraeuter et al. | 36/114 |
| 6,000,148 | A | 12/1999 | Cretinon | 36/88 |
| 6,079,125 | A | 6/2000 | Quellais et al. | |
| 6,199,303 | B1 * | 3/2001 | Luthi et al. | 36/31 |
| 6,321,469 | B1 | 11/2001 | Cretinon | 36/102 |
| 6,416,610 | B1 | 7/2002 | Matis et al. | 156/245 |
| 6,497,058 | B1 * | 12/2002 | Dietrich et al. | 36/69 |
| 6,502,330 | B1 * | 1/2003 | David et al. | 36/88 |
| 6,594,922 | B1 * | 7/2003 | Mansfield et al. | 36/145 |
| 6,775,930 | B1 * | 8/2004 | Fuerst | 36/103 |
| 2002/0020078 | A1 * | 2/2002 | Bressoux et al. | 36/30 R |

FOREIGN PATENT DOCUMENTS

| | | |
|---|---|---|
| EP | 1205121 | 5/2002 |
| WO | WO02/07555 | 1/2002 |

* cited by examiner

*Primary Examiner*—Marie Patterson
(74) *Attorney, Agent, or Firm*—Greenblum & Bernstein, P.L.C.

(57) ABSTRACT

An article of footwear that includes a bottom assembly, the bottom assembling including at least a wear sole and an element for reinforcing the bottom assembly, and an upper including a reinforcement element coupled to the reinforcement element of the bottom assembly. The coupling of the element for reinforcing the bottom assembly and of the element for reinforcing the upper is flexible at least in a transverse direction.

20 Claims, 4 Drawing Sheets

ARTICLE OF FOOTWEAR

CROSS-REFERENCE TO RELATED APPLICATION

This application is based upon French Patent Application No. 02.16239, filed Dec. 11, 2002, the disclosure of which is hereby incorporated by reference thereto in its entirety and the priority of which is hereby claimed under 35 U.S.C. §119.

BACKGROUND OF THE INVENTION

1. Field of the Invention

The invention relates to shoes and boots, and other articles of footwear, having a bottom assembly in the form of a structure having several layers or elements providing distinct functions. More particularly, the invention relates to the coupling of one element for reinforcing the upper of the article of footwear to one of the elements of the bottom assembly.

2. Description of Background and Relevant Information

U.S. Pat. No. 6,000,148 describes the construction of an article of footwear, i.e., a shoe or boot construction having, on the one hand, a bottom assembly with a wear sole and an element for reinforcing the bottom assembly and, on the other hand, an element for reinforcing the upper which is coupled to the element for reinforcing the bottom assembly, a shock absorbing and elastic reinforcement layer of the bottom assembly being interposed between the upper and the element for reinforcing the bottom assembly.

The coupling of the elements for reinforcing the upper and for reinforcing the bottom assembly allows for an optimum transmission of the foot movements to the sole.

Such a construction is particularly advantageous for walking or running on uneven ground because it improves the stability of the foot and it improves the precision of the supporting forces in the bottom assembly/ground interface while allowing foot rolling movement.

Such a construction is therefore particularly suited for "raid"-type applications, i.e., cross-country types of shoes or boots, particularly those involving foot races on uneven terrain.

Although the shoe/boot is very satisfactory and has an excellent hold and stability in the transverse direction, this type of construction is nonetheless too rigid, particularly in the transverse direction, for certain users who prefer the racing aspect and/or whose preference for transverse stability in a boot or shoe is reduced in significance.

SUMMARY OF THE INVENTION

An object of the present invention is to overcome the drawbacks and to improve a boot of the aforementioned type.

This object is achieved in the boot according to the invention, which is of the type having, on the one hand, a bottom assembly with at least one wear sole and one element for reinforcing the bottom assembly and, on the other hand, one element for reinforcing the upper which is coupled to the element for reinforcing the bottom assembly, in that the coupling of the element for reinforcing the bottom assembly and of the element for reinforcing the upper is flexible at least in the transverse direction.

Indeed, the flexible coupling in the transverse direction of the element for reinforcing the bottom assembly and of the element for reinforcing the upper allows the boot to be softened, or made more pliable or flexible, for an application of the boot or shoe to racing, while retaining the aspect of having an excellent transmission of the foot movements to the sole by means of the upper.

Such a construction is therefore always adapted for use on uneven ground, while being more optimized for an application to racing.

According to a preferred embodiment, the coupling of the element for reinforcing the bottom assembly and of the element for reinforcing the upper occurs by means of an intermediary shock absorbing sole.

BRIEF DESCRIPTION OF DRAWINGS

The invention will be better understood and other characteristics thereof will be shown by means of the following description, with reference to the attached schematic drawings showing, by way of non-limiting examples, several embodiments, and in which.

DETAILED DESCRIPTION OF THE INVENTION

Figure 1:
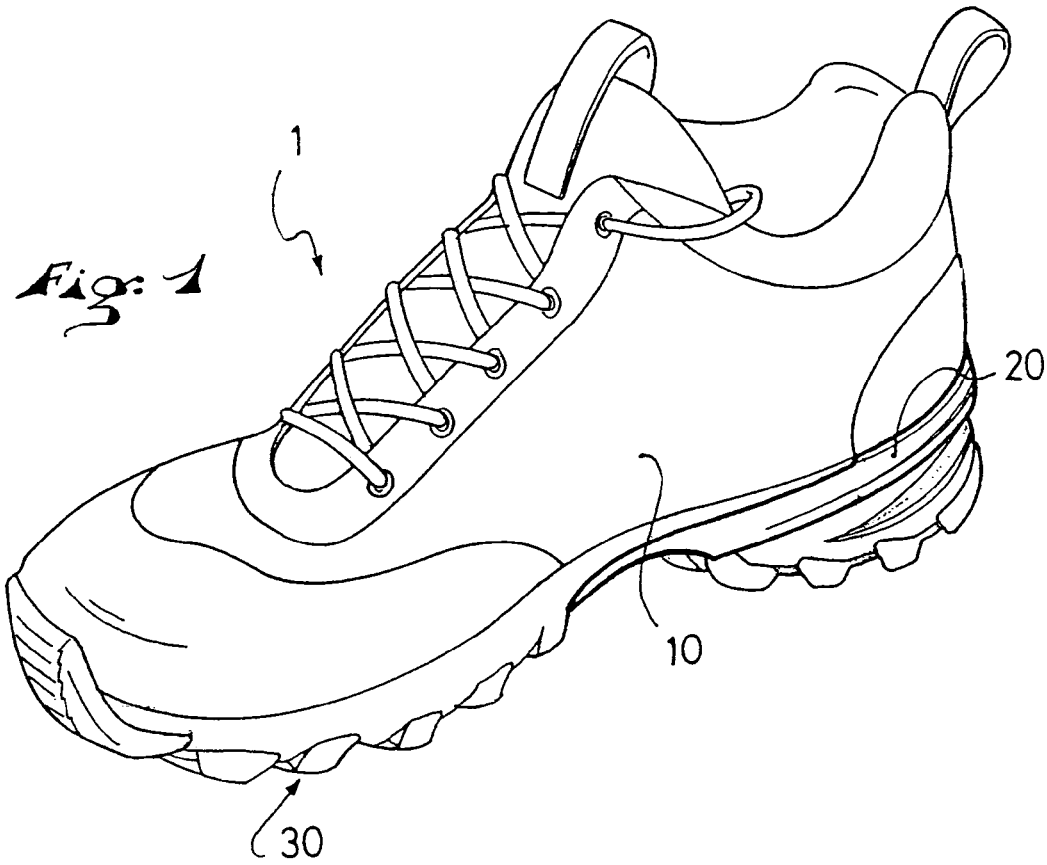
FIG. 1 is a front perspective view of a boot having an upper and bottom assembly reinforcement according to the invention.
Figure 2:
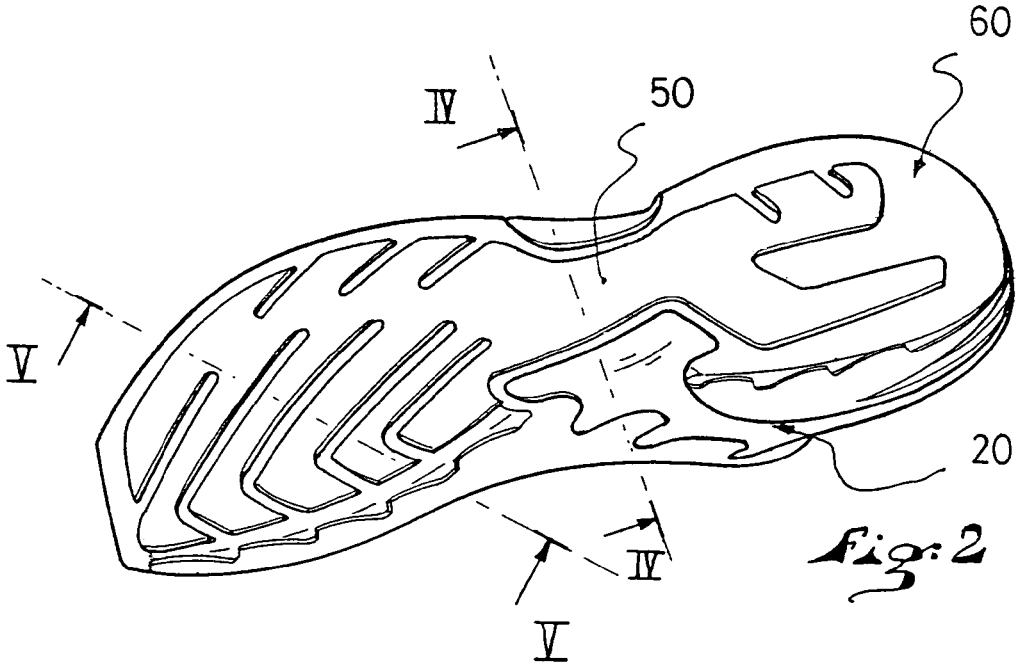
FIG. 2 is a view of the bottom assembly reinforcement/intermediary sole assembly.

The article of footwear 1, hereinafter also referred to as a "boot", shown by way of a non-limiting example in FIG. 1, has an upper 10 provided with an upper reinforcement 20 and a bottom assembly 30 having a layered structure described hereinafter with reference to FIGS. 2–5.

Figure 3:
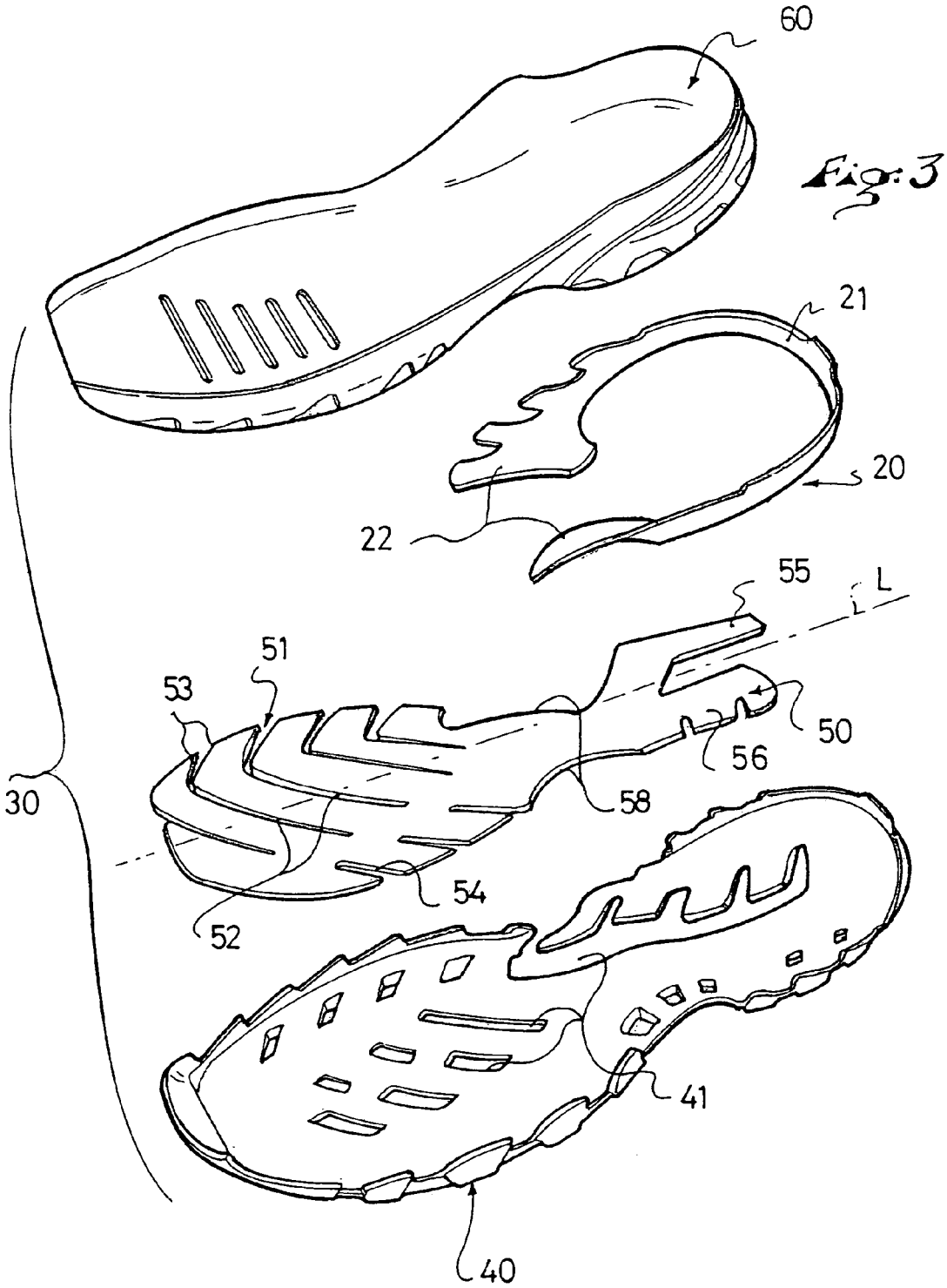
FIG. 3 is an exploded perspective view of the entire bottom assembly before the various parts are assembled.
Figure 4:
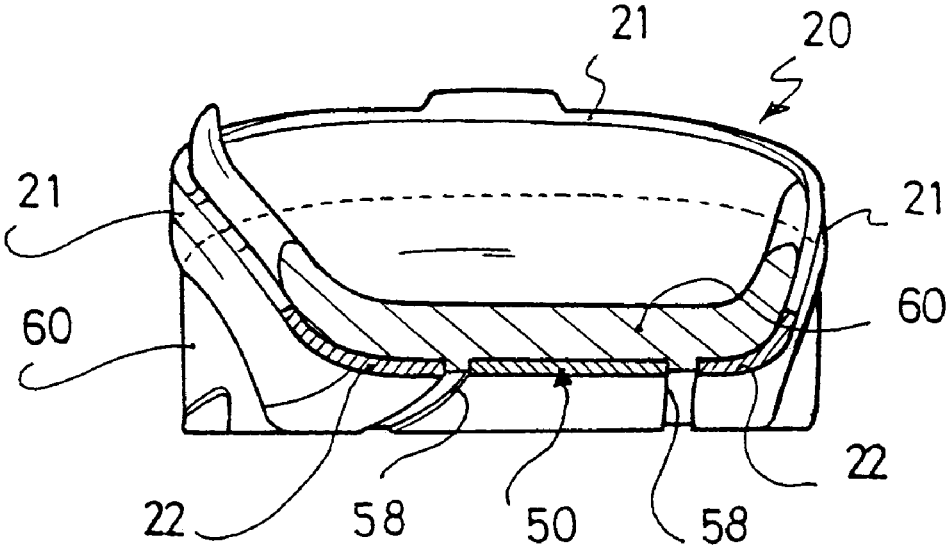
FIG. 4 is a cross-sectional view along the line IV—IV of FIG. 2.
Figure 5:
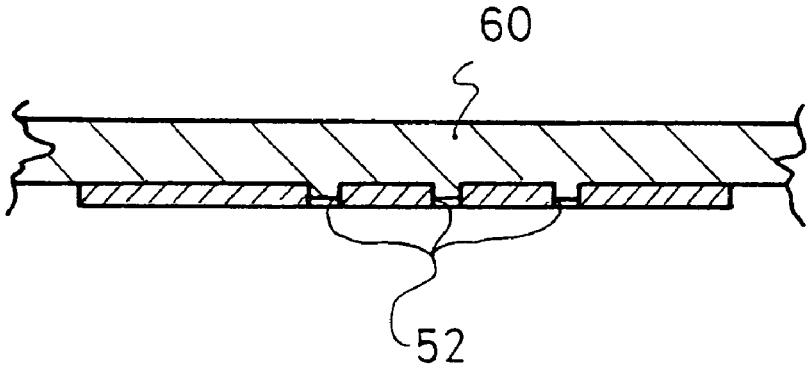
FIG. 5 is a cross-sectional view along the line V—V of FIG. 2.

As shown more specifically in FIG. 3, the bottom assembly 30 is constituted, from the base upwards, of a wear sole 40, an element 50 for reinforcing the bottom assembly, and an intermediary sole 60.

The wear sole 40, also called the walking sole or external sole, is made of an adherent material that resists wear, such as rubber, preferably, but also polyurethane or polymer on a thermoplastic base.

The intermediary sole 60 is made of a shock absorbing material, such as EVA, polyurethane, or an alloy of thermosetting polymers.

It is affixed directly to the upper 10 of the boot and extends over the entire surface of the bottom assembly, i.e., from the area of the toes to the area of the heel. The element 50 for reinforcing the bottom assembly is constituted by a plate made of a relatively rigid material which preferably has elasticity characteristics, such as polyamide, polyurethane, PEBE, PEBA, or PBT.

It can also be constituted by a textile insert that is preferably inextensible and abrasion resistant, such as polyester or polyamide, stiffened by glue, such as a heat-meltable polyurethane glue, or neoprene.

Each of the elements 40, 50, 60 forming the bottom assembly forms a layer extending substantially over the entire surface of the bottom assembly and/or the foot of the wearer. The reinforcement element 50 in particular extends practically over the entire length of the bottom assembly corresponding to the length of the wearer's foot, and has cut outs adapted to make the reinforcement softer, i.e., more supple or flexible, in the transverse and/or longitudinal direction in order to allow for a better foot rolling movement and more sensation in the transverse direction.

Thus, the reinforcement element 50 has, at the front, slits 51 in a herringbone pattern that extend up to the medial edge of the reinforcement element 50. Each slit 51 has a long arm 52 oriented substantially along, or parallel to, the foot metatarsophalangeal axis, and extending over approximately half of the transverse surface of the reinforcement element 50.

These slits 52 are adapted to facilitate the flexion of the reinforcement element 50, along the direction, or parallel to the direction, of the metatarsophalangeal articulation axis, and therefore to facilitate foot rolling movement.

Each long arm 52 of each slit 51 extends up to the medial edge of the reinforcement element 50 by a short arm 53 extending 90°, or substantially 90°, with respect to the direction of the long arm 52.

The object of these short arms or slits 53 is to render the reinforcement element 50 softer or more flexible along the medial edge for a better feel of the ground.

Small slits 54 oriented in the extension of the slits 52 and, therefore, symmetrically with the slits 53 with respect to the longitudinal axis L of the reinforcement element 50, extend up to the lateral edge of the reinforcement element 50, so as to render this lateral edge of the reinforcement element more flexible or supple for a better feel of the ground.

In the area of the heel, the reinforcement element 50 is subdivided into two medial 55 and lateral 56 arms, respectively, in order to render more flexible or supple the reinforcement element 50 in the transverse direction and to provide for a better sensation, from the one medial edge to the other lateral edge of the bottom assembly, and vice-versa. In the area of the plantar arch, the reinforcement element is thinner and has straight or slightly concave edges 58.

The particular shape/form of the reinforcement element shown and described hereinabove can be different depending on the effects desired. The shape/form described hereinabove is specifically designed for an application to racing, hence the bending during foot rolling movement and the cut outs adapted for facilitating or promoting sensations.

The wear sole 40 extends essentially over the entire surface of the bottom assembly and has cut outs 41 adapted essentially to show the reinforcement element 50.

The element 20 for reinforcing the upper is constituted in the present case of a substantially U-shaped three-dimensional element 21, having a return 22 at each of its ends.

The U-shaped portion 21 of the element 20 for reinforcing the upper is adapted to encircle the heel portion of the intermediary sole 60 and of the upper 10 of the boot, and to be affixed thereto by adhesive or glue.

Each of the returns 22 of the reinforcement element 20 extends transversely toward the inside with respect to the U-shaped portion, beneath the intermediary sole, so as to abut against the edges 58 of the element 50 for reinforcing the bottom assembly in the area of the plantar arch zone while leaving a clearance between approximately 0 and 5 millimeters.

The coupling of the reinforcement element 20 to the reinforcement element 50 occurs by means of the intermediary sole 60 to which these two elements are affixed, for example, by glue/adhesive.

Preferably, the surface of the EVA sole has recesses, or depressions, that correspond to the profiles/contours of the two reinforcement elements 20, 50, whose depth corresponds to the thickness of these reinforcement elements.

When assembling the boot, the two reinforcement elements 20, 50 are positioned in the associated depressions of the surface of the intermediary sole 60 and assembled to the latter by gluing. The wear sole 40 is also glued to the assembly, and the bottom assembly 30 thus constituted is assembled to the upper 10 of the boot by gluing. The upper U-shaped portion 21 of the reinforcement element 20 is also glued to the upper.

Through this construction, one obtains, by means of the adhesive connection to the intermediary sole 60, a flexible coupling of the element 20 for reinforcing the upper to the element 50 for reinforcing the bottom assembly. In fact, the element 20 is both an element 20 for reinforcing the upper and for reinforcing the bottom assembly 30.

This flexible coupling of the two types of reinforcements 20, 50, via the intermediary sole 60, reconciles the contradictory requirements for stiffness, lateral retention of the foot on uneven ground, and flexibility related to the requirements of foot races.

Figure 6:
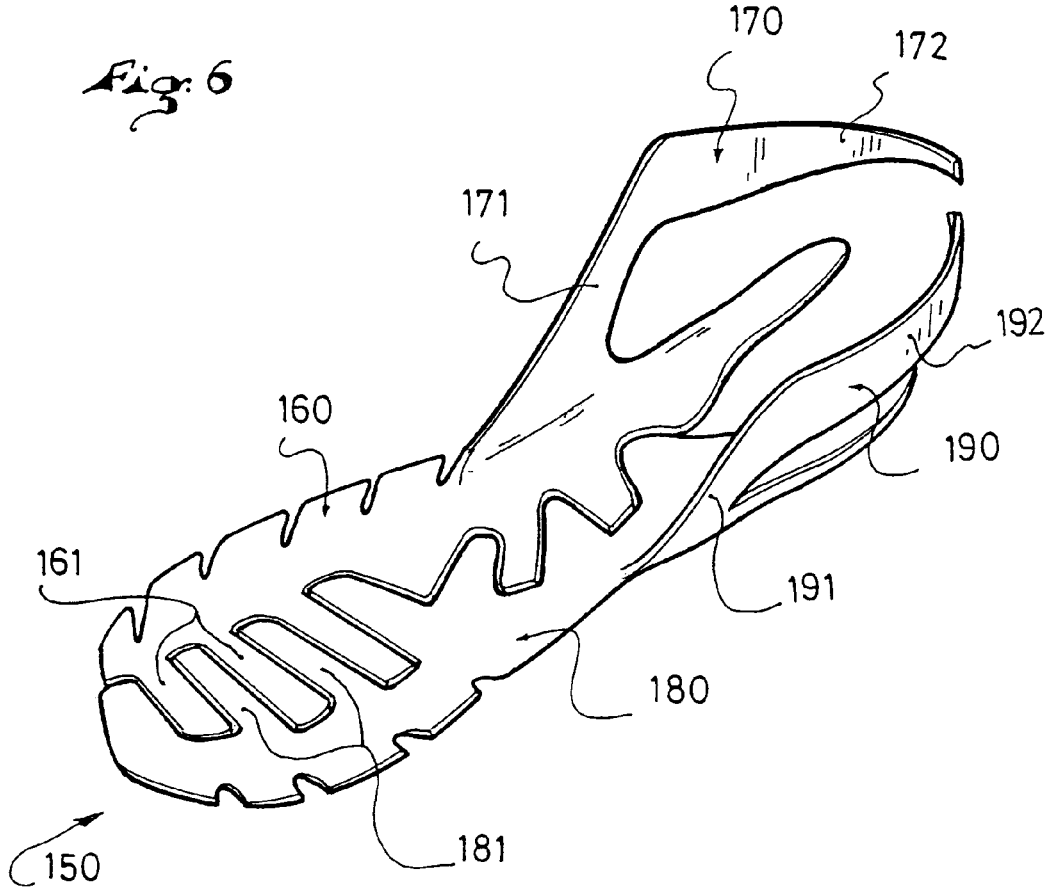
FIG. 6 is a perspective view of an element for reinforcing the bottom assembly and the upper according to a second embodiment.

FIG. 6 illustrates another embodiment in which the elements for reinforcing the upper and the sole are integrated on the medial and lateral sides. In this case, the element 150 for reinforcing the bottom assembly is constituted of two medial 160, 170 and lateral 180, 190 portions, respectively. The medial portion has a substantially planar elongated portion 160 extending, in the longitudinal direction, over half of the bottom assembly, and an arm 170 halfway around the heel on the medial side. The arm 170 has a vertical tab 171 rising from the flat portion 160 in the area of the plantar arch zone and being rounded off by a semi U-shaped tab 172 around the first half of the heel on the medial side. The other portion 180, 190 of the reinforcement element symmetrically has a substantially planar elongated portion 180 extending, in the longitudinal direction, over half of the bottom assembly, and an arm 190 halfway around the heel on the lateral side by a vertical tab 191 and a semi U-shaped tab 192.

The two planar portions 160, 180 have transverse tabs 161, 181, respectively, nested one in the other.

The coupling of these two medial and lateral reinforcement portions occurs the same as before by adhesively securing each of these two portions to the intermediary sole in the area of their flat portions 160, 180, and in the area of the upper by means of their arms 170, 190.

Coupling therefore occurs essentially in the longitudinal direction, with a transverse effect along the length of the transverse tabs 161, 181.

This embodiment has the advantage of allowing for a varying stiffness of the reinforcement elements 160, 170 and 180, 190, and consequently of providing an, asymmetrical stiffness/reinforcement on the medial and lateral sides, depending on the effect desired.

The present invention is not limited to the particular embodiments which have been described hereinabove as non-limiting examples, but encompasses all similar or equivalent embodiments.

What is claimed is:

1. An article of footwear comprising:

an upper;

a bottom assembly including at least one wear sole and at least one element for reinforcing said bottom assembly, said at least one element for reinforcing said bottom assembly including a first reinforcement element, said first reinforcement element extending in a longitudinal direction;

at least one element for reinforcing said upper, said at least one element for reinforcing said upper including a second reinforcement element;

a flexible coupling comprising a shock-absorbing intermediary sole situated between at least said first reinforcement element and at least said second reinforcement element, said first reinforcement element and said second reinforcement element extending beneath said intermediary sole being flexible at least in a direction transverse to said longitudinal direction, said first reinforcement element and said second reinforcement element being coupled together via said intermediary sole.

2. An article of footwear according to claim 1, wherein:

each of said at least one element for reinforcing said bottom assembly and each of said at least one element for reinforcing said upper is assembled to said intermediary sole with adhesive.

3. An article of footwear according to claim 2, wherein:

said intermediary sole comprises EVA.

4. An article of footwear according to claim 1, wherein:

said element for reinforcing said upper is also coupled to said upper.

5. An article of footwear according to claim 4, wherein:

said element for reinforcing said upper comprises a medial arm extending along a medial side of a rear area of a wearer's foot and a lateral arm extending along a lateral side of said rear area of the wearer's foot.

6. An article of footwear according to claim 5, wherein:

said medial and lateral arms of said element for reinforcing said upper are associated, respectively, with medial and lateral portions, of said element for reinforcing said bottom assembly.

7. An article of footwear according to claim 6, wherein:

said elements for reinforcing said upper and bottom assembly have asymmetrical shapes with respect to said medial and lateral sides, thereby providing asymmetrical reinforcement of said upper and bottom assemblies with respect to said medial and lateral sides.

8. An article of footwear according to claim 1, wherein:

said element for reinforcing said upper comprises at least one portion extending around an area adapted to surround a rear area of a wearer's foot.

9. An article of footwear according to claim 1, wherein:

said intermediary sole comprises surface depressions; and said first and second reinforcement elements are assembled to said surface depressions of said intermediary sole.

10. An article of footwear according to claim 9, wherein:

said first and second reinforcement elements are spaced apart.

11. An article of footwear according to claim 9, wherein:

said first and second reinforcement elements are spaced apart at least in a plantar arch zone of said bottom assembly.

12. An article of footwear according to claim 9, wherein:

said first and second reinforcement elements are assembled to said surface depressions of said intermediary sole with adhesive.

13. An article of footwear according to claim 1, wherein:

said intermediary sole comprises surface depressions; and said first and second reinforcement elements are assembled to said surface depressions of said intermediary sole with adhesive, leaving a clearance between said first and second reinforcements elements at least in a plantar arch zone of the bottom assembly.

14. An article of footwear comprising:

an upper;

a bottom assembly including at least one wear sole and at least one element for reinforcing said bottom assembly, said at least one element for reinforcing said bottom assembly including a first reinforcement element, said first reinforcement element extending in a longitudinal direction, said first and second reinforcement elements being spaced apart at least in a plantar arch zone of said bottom assembly by no more than 5 millimeters;

at least one element for reinforcing said upper, said at least one element for reinforcing said upper including a second reinforcement element;

a flexible coupling comprising a shock-absorbing intermediary sole having surface depressions, said intermediary sole being situated between at least said first reinforcement element and at least said second reinforcement element, said intermediary sole being flexible at least in a direction transverse to said longitudinal direction;

said first reinforcement element and said second reinforcement element being coupled together via said intermediary sole by way of said first and second reinforcement elements being assembled to said surface depressions of said intermediary sole.

15. An article of footwear comprising:

an upper;

a bottom assembly including at least one wear sole and at least one element for reinforcing said bottom assembly, said at least one element for reinforcing said bottom assembly including a first reinforcement element, said first reinforcement element extending in a longitudinal direction;

at least one element for reinforcing said upper, said at least one element for reinforcing said upper including a second reinforcement element;

a flexible coupling comprising a shock-absorbing intermediary sole situated between at least said first reinforcement element and at least said second reinforcement element, said intermediary sole being flexible at least in a direction transverse to said longitudinal direction, said first reinforcement element and said second reinforcement element being coupled together via said intermediary sole;

said second reinforcement element encircling a rear end of said upper and extending forwardly in the form of medial and lateral returns;

each of said returns of said second reinforcement element extending in a direction transverse to said longitudinal direction toward a respective edge of said first reinforcement element, leaving a clearance with said first reinforcement element.

16. An article of footwear according to claim 15, wherein:

said clearance between said medial return and said first reinforcement element is no greater than 5 millimeters; and said clearance between said lateral return and said first reinforcement element is no greater than 5 millimeters.

17. An article of footwear comprising:

a bottom assembly including at least one wear sole and at least one element for reinforcing said bottom assembly, said at least one element for reinforcing said bottom assembly comprising a longitudinally extending first reinforcement element;

an upper mounted on said bottom assembly;

at least one element for reinforcing said upper, said at least one element for reinforcing said upper comprising a second reinforcement element;

an intermediary sole comprising a shock-absorbing material extending from a heel area of said bottom assembly to a toe area of said bottom assembly;

said first and second reinforcement elements being separately attached to said intermediary sole with adhesive;

said second reinforcement element extending around a rear of said upper and a rear of said bottom assembly, and extending forwardly in the form of medial and lateral returns;

each of said returns of said second reinforcement element extending in a direction transverse to said longitudinal direction toward a respective edge of said first reinforcement element, leaving a clearance with said first reinforcement element.

18. An article of footwear according to claim 17, wherein:

said first reinforcement element and said second reinforcement element extend beneath said intermediary sole.

19. An article of footwear comprising:

a bottom assembly including at least one wear sole and at least one element for reinforcing said bottom assembly, said at least one element for reinforcing said bottom assembly comprising a longitudinally extending first reinforcement element;

an upper mounted on said bottom assembly;

at least one element for reinforcing said upper, said at least one element for reinforcing said upper comprising a second reinforcement element;

an intermediary sole comprising a shock-absorbing material extending from a heel area of said bottom assembly to a toe area of said bottom assembly;

said first and second reinforcement elements being separately attached to said intermediary sole with adhesive;

said second reinforcement element extending around a rear of said upper and a rear of said bottom assembly, and extending forwardly in the form of medial and lateral returns;

each of said returns of said second reinforcement element extending transversely toward a respective edge of said first reinforcement element, leaving a clearance with said first reinforcement element;

said clearance between said medial return and said first reinforcement element is no greater than 5 millimeters; and said clearance between said lateral return and said first reinforcement element is no greater than 5 millimeters.

20. An article of footwear according to claim 19, wherein:

said intermediary sole has depressions for receiving said first and second reinforcement elements, said first and second reinforcement elements being attached to said intermediary sole in said depressions with adhesive.

* * * * *